US006223953B1

(12) United States Patent
Arslanouk et al.

(10) Patent No.: US 6,223,953 B1
(45) Date of Patent: May 1, 2001

(54) POWDER FEED SYSTEM

(75) Inventors: Mahmoud Arslanouk, Halendon, NJ (US); Anthony DiMaio, Haverhill, MA (US)

(73) Assignee: Nylok Fastener Corp., MaComb, MI (US)

( * ) Notice: Subject to any disclaimer, the term of this patent is extended or adjusted under 35 U.S.C. 154(b) by 0 days.

(21) Appl. No.: 09/490,968

(22) Filed: Jan. 24, 2000

Related U.S. Application Data

(63) Continuation-in-part of application No. 09/327,034, filed on Jun. 7, 1999.

(51) Int. Cl.[7] ..... B67D 5/64
(52) U.S. Cl. ..... 222/161; 222/199; 222/330
(58) Field of Search ..... 222/51, 161, 199, 222/330; 239/56, 144, 374

(56) References Cited

U.S. PATENT DOCUMENTS 3,777,874 12/1973 Birckhead .
3,882,820 5/1975 Hock et al. .
4,579,482 4/1986 Gastaldi et al. .
4,627,990 12/1986 Saga et al. .
4,712,669 12/1987 Rohr .
4,813,818 3/1989 Sanzone .
5,474,609 12/1995 Mulder et al. .
5,547,549 8/1996 Fraas .
5,607,720 3/1997 Wallace et al. .
5,908,155 6/1999 Duffy et al. .

*Primary Examiner*—Joseph A. Kaufman
*Assistant Examiner*—David Deal
(74) *Attorney, Agent, or Firm*—Niro, Scavone, Haller & Niro

(57) ABSTRACT

The present invention is directed to a vibratory powder feeding and metering apparatus that achieves the above-mentioned requirements. Generally, the apparatus of the present invention includes a housing defining a powder reservoir, a powder storage hopper having an outlet disposed to deliver powdered resin to the reservoir, a powder distribution block having one or more generally vertical fill tubes, a plurality of discharge ports extending from the reservoir to the fill tubes in the distribution block, and a vibration device to which the housing is mounted. Typically, the fill tubes are in communication with individual spray nozzles for transmission of the powdered resin. The housing also carries an adjustable barrier which serves as a dam to control or meter the flow of powdered resin into the discharge ports.

7 Claims, 5 Drawing Sheets

POWDER FEED SYSTEM

The present application is a Continuation-in-Part of U.S. patent application Ser. No. 09/327,034 filed Jun. 7, 1999.

BACKGROUND OF THE INVENTION

The present invention relates generally to powder conveying systems. More particularly, the present invention is directed to a powder feeding and metering apparatus for use in delivering powdered resin to a powdered resin spray nozzle. The invention finds particularly advantageous application in processes for applying powdered resin to fasteners.

A variety of vibratory powder feed systems have been known in the art for many years. Such feeding systems, dating back to the 1950s and 1960s, have included both rotationally vibrated bowls and linearly vibrated channels or troughs.

In the field of threaded fasteners, a need exists for feed systems useful for the application of powdered resins onto the fasteners. These resins, once applied, may serve any of several functions, including locking, sealing, lubrication or masking. Oftentimes the same feed apparatus will therefore be used with different resin powders, each having its own particle size distribution, specific gravity, coefficient of friction and perhaps other properties that affect its flow characteristics. Moreover, the same feed apparatus may be used with many different fastener sizes thereby requiring substantially different powder flow rates. Still further, the apparatus may be used with different spray assemblies, using one, two, three or even four spray nozzles.

As a result a need exists for a simple, efficient vibratory feed apparatus that offers great versatility while still accurately feeding and metering the powdered resin for spray application to threaded fasteners.

SUMMARY OF THE INVENTION

The present invention is directed to a vibratory powder feeding and metering apparatus that achieves the above-mentioned requirements. Generally, the apparatus of the present invention includes a housing defining a powder reservoir, a powder storage hopper having an outlet disposed to deliver powdered resin to the reservoir, a powder distribution block having one or more generally vertical fill tubes, a plurality of discharge ports extending from the reservoir to the fill tubes in the distribution block, and a vibration device to which the housing is mounted. Typically, the fill tubes are in communication with individual spray nozzles for transmission of the powdered resin. The housing also carries an adjustable barrier which serves as a dam to control or meter the flow of powdered resin into the discharge ports.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

DETAILED DESCRIPTION OF THE PREFERRED EMBODIMENTS

Figure 1:
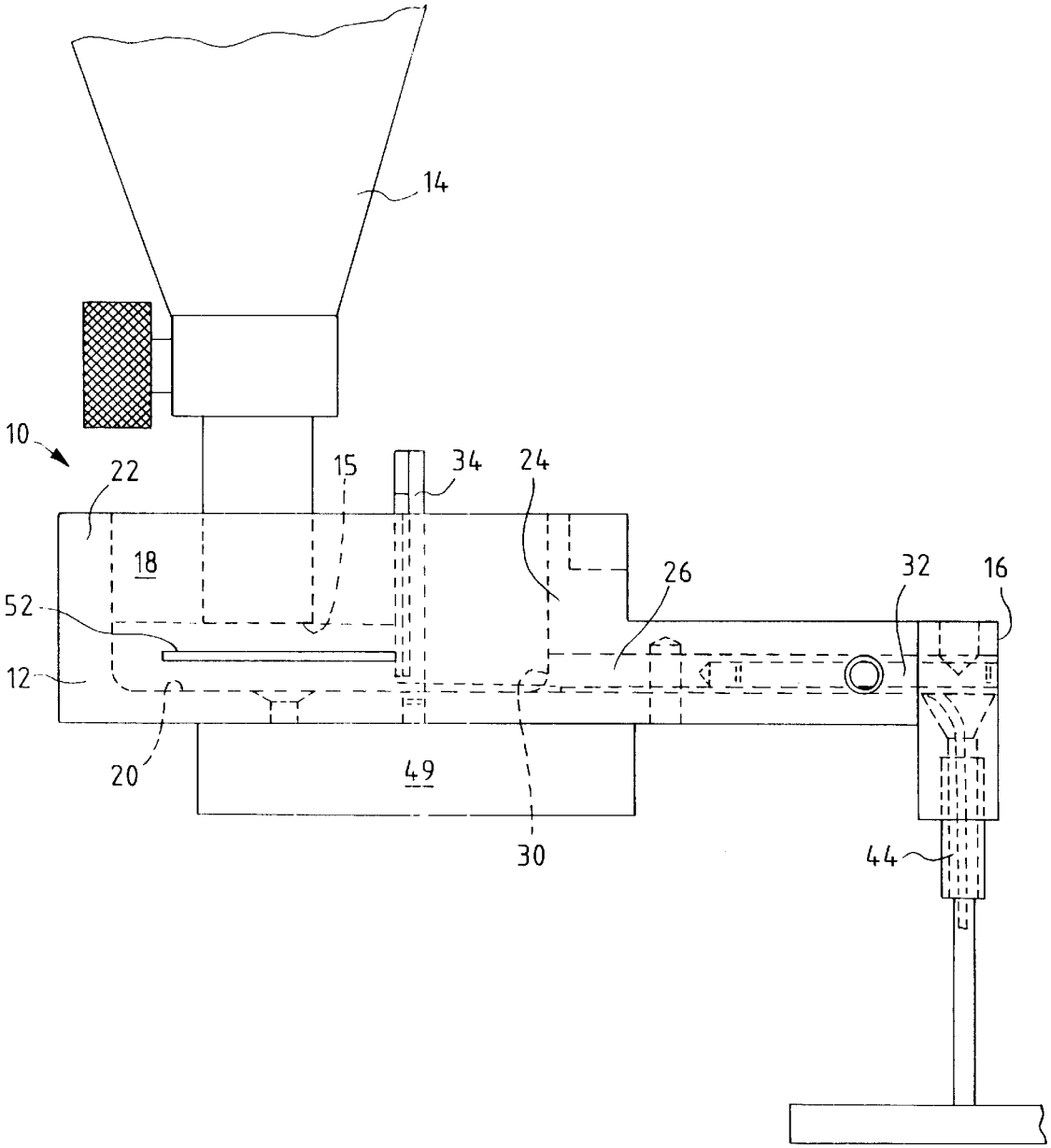
FIG. 1 is a side view of the powder feeding and metering apparatus of the present invention, also illustrating, in schematic fashion, the supply of powdered resin to a typical powder spray nozzle.
Figure 2:
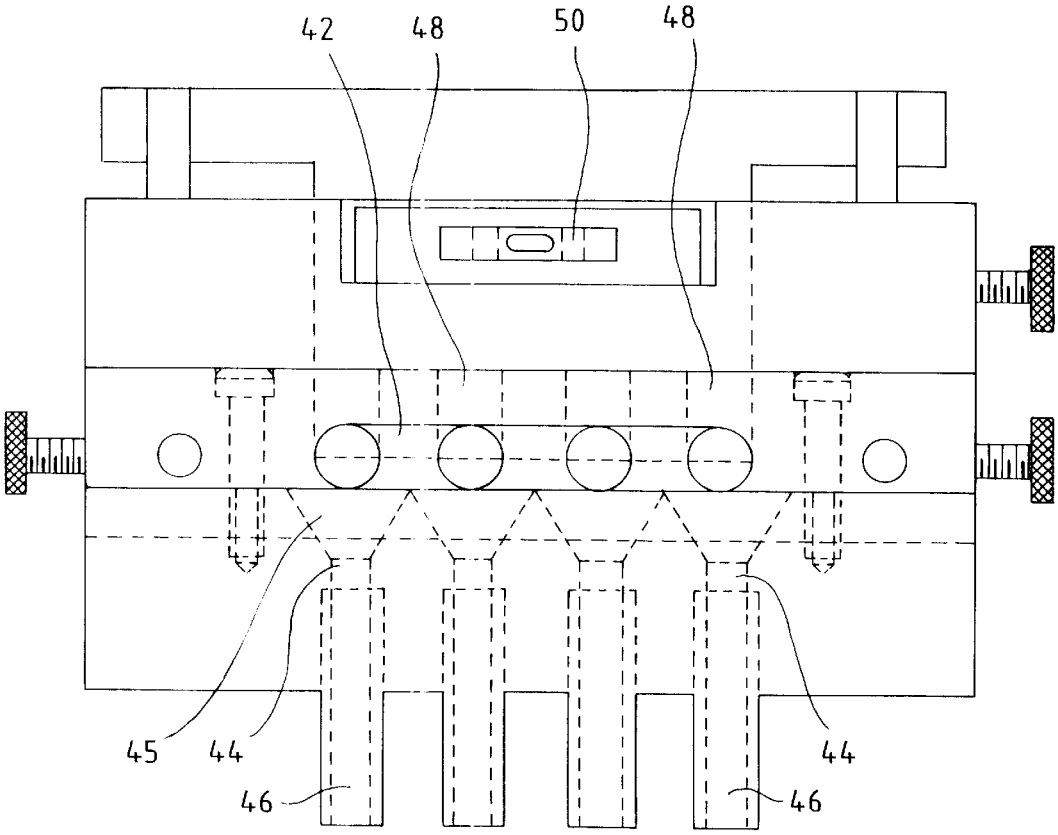
FIG. 2 is an end view of the apparatus of FIG. 1 having a powder distribution block used with a four nozzle application.
Figure 5:
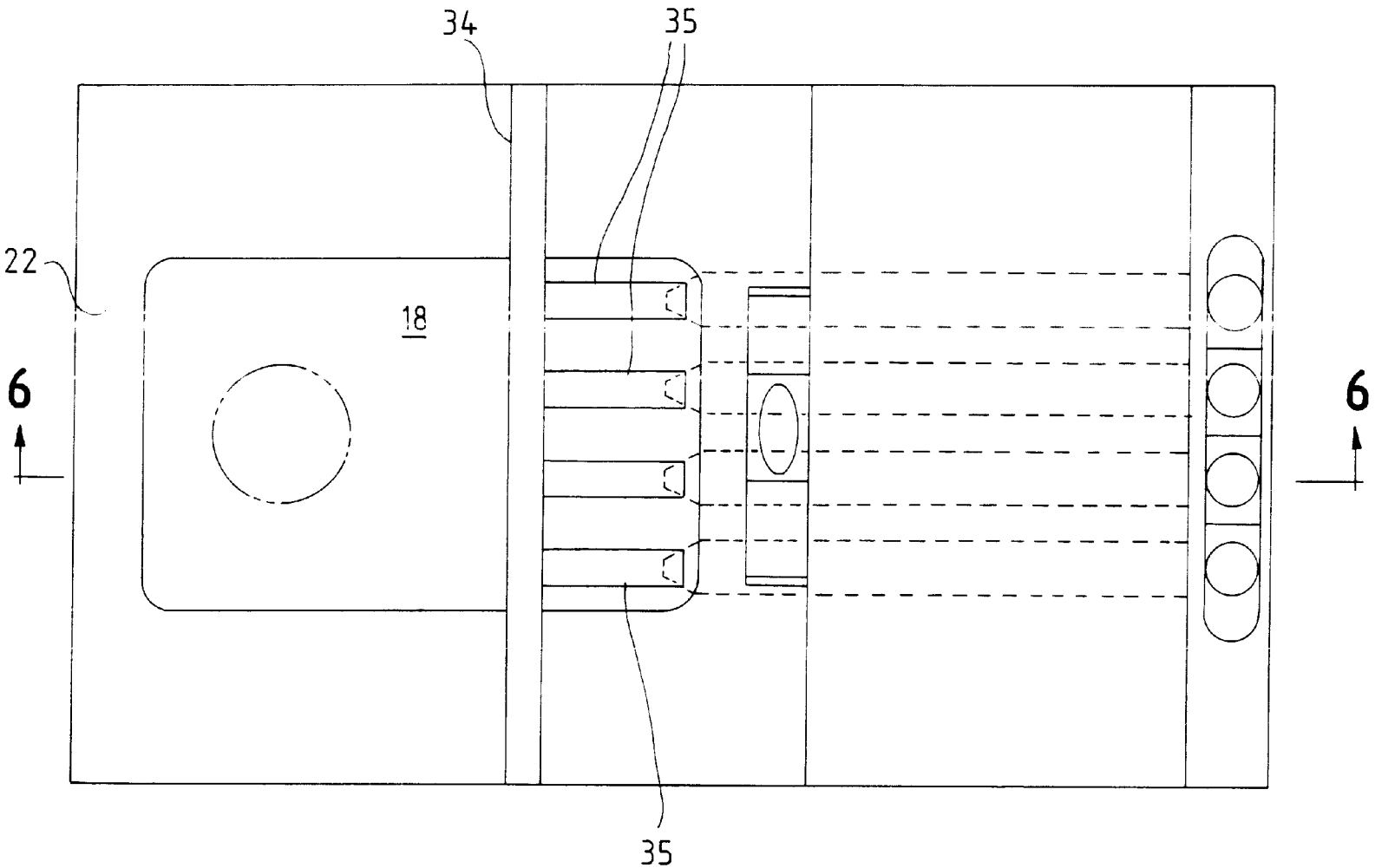
FIG. 5 is a top view of another embodiment of the powder feeding and metering apparatus of the present invention.
Figure 6:
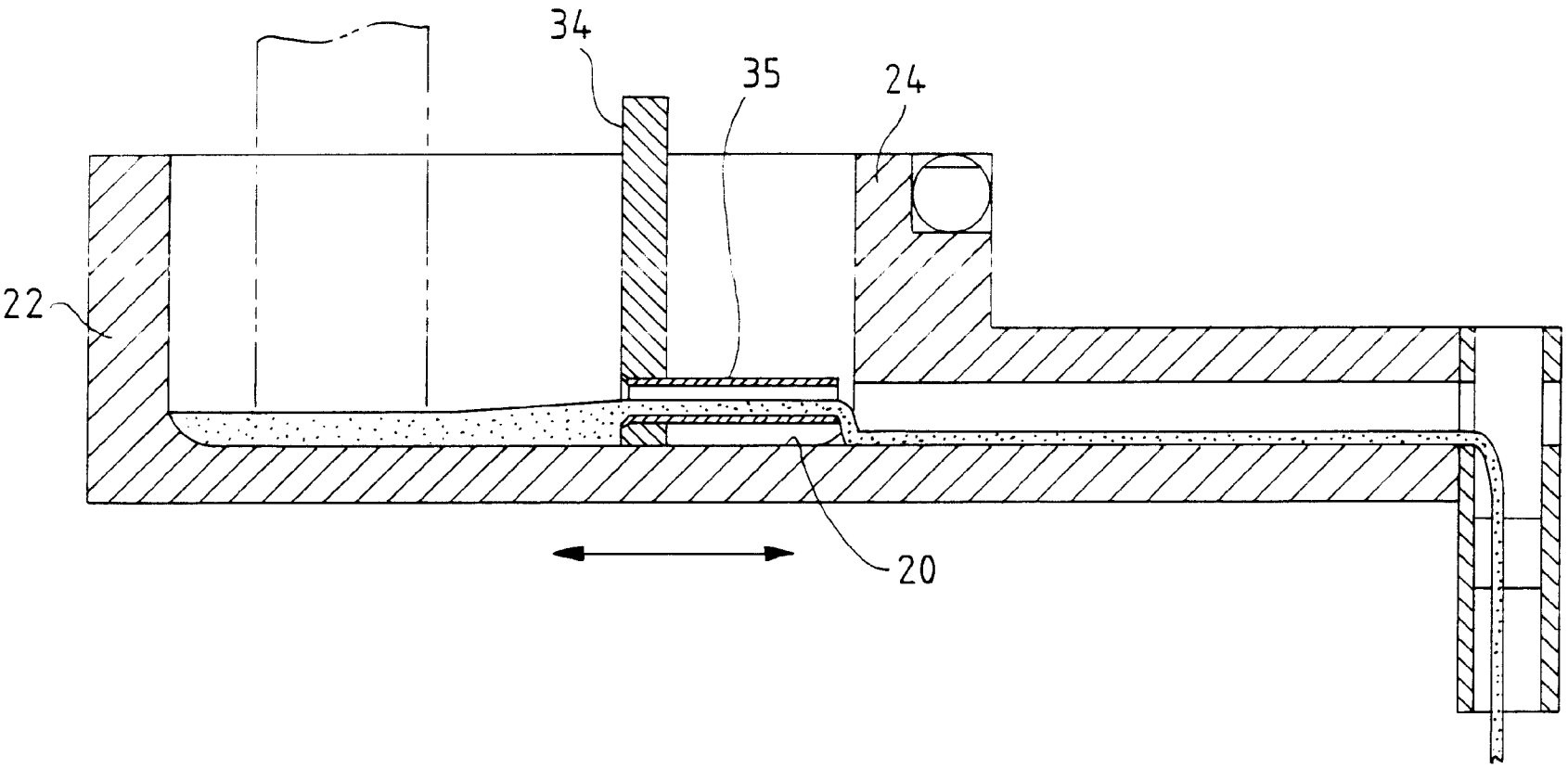
FIG. 6 is a cross-sectional view taken along line 6—6 of FIG. 5.

As illustrated in the drawings, the powder feeding and metering apparatus of the present invention is designated generally as 10, and includes housing 12, storage or supply hopper 14, and distribution block 16. The housing 12 defines a powdered resin reservoir 18 having a generally horizontally oriented floor 20 between and walls 22 and 24. Extending through end wall 24 are a plurality of generally horizontally oriented discharge ports 26, each having an inner end 30 in communication with the reservoir 18 and an outer end 32. The housing 12 also supports a generally vertical and adjustable barrier 34 which together with the floor 20 of the housing defines a metering orifice through which the powdered resin flows. Alternatively, the barrier 34 may be disposed in direct abutment with floor 20 and may have one or more metering apertures to meter powder flow. Still other barriers with differently sized metering apertures or slots may also be used to vary the powder flow rate. For example, FIGS. 5 and 6 illustrate a barrier 34 in abutment with floor 20 and having a series of one or more tubes 35 extending from the barrier 34 toward end wall 24. This arrangement has been found desirable when the powder flow rate through the devices is relatively low, for example in the range of about 2.0 to 15 grams per minute. At these lower flow rates, the barrier design illustrated in FIG. 1 may be inconsistent because the powder has a tendency to agglomerate and flow inconsistently when the passageway between the barrier 34 and floor 20 is relatively small, i.e. less than about ⅛ or 1/16 inch.

The supply hopper 14 has an outlet 15 disposed to deliver powdered resin to reservoir 18. This form of powder delivery is conventionally known as a "flood fill" technique and has been used in powder transfer apparatus for many years. As is well known in the art, the powder level in the reservoir 18 will be maintained at the level of the bottom of the outlet 15.

Figure 3:
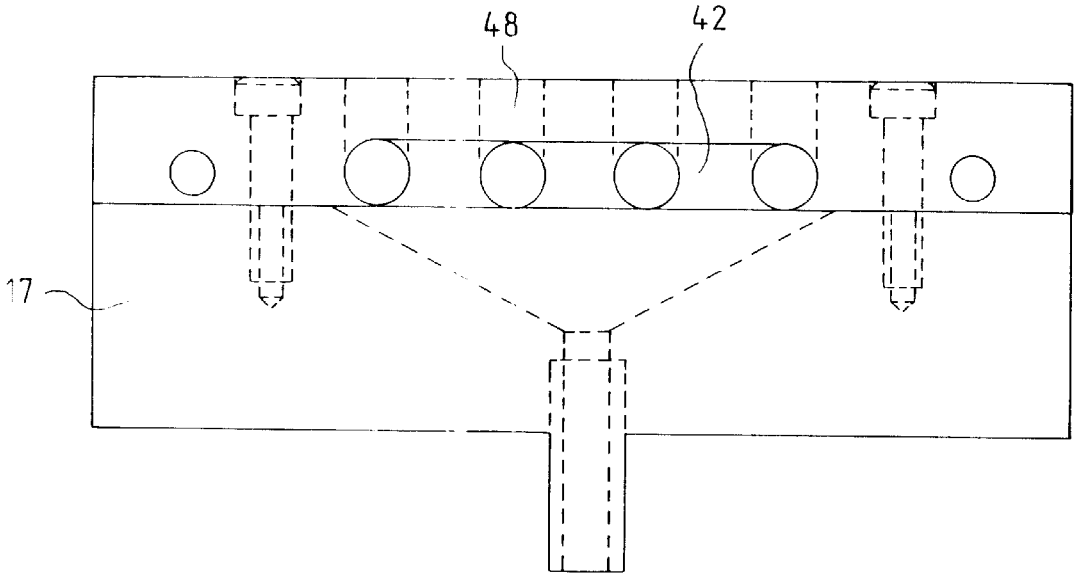
FIGS. 3 and 4 are each end views showing distribution blocks used, respectively, with one and two nozzle applications.
Figure 4:
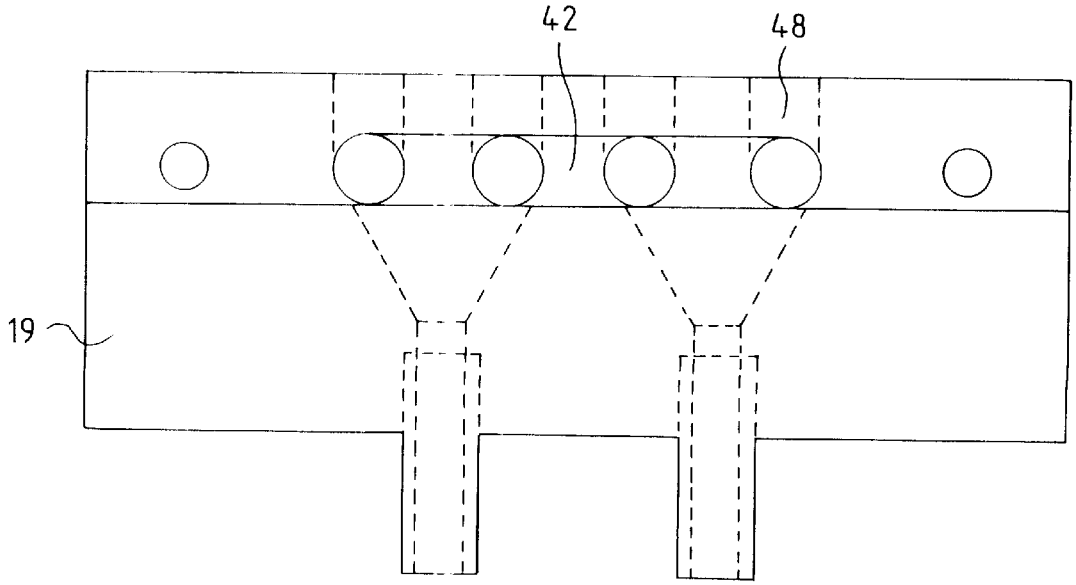

The powder distribution block 16 is mounted to housing 12. Block 16 includes a common passageway 42 and one or more powder fill tubes 44, each in communication with the passageway 42. The upper powder receiving end 45 of each fill tube is supplied powdered resin exiting the outer ends 32 of the discharge ports 26. The lower powder distributing end 46 of the fill tube is in communication with the powder supply port of a conventional powder spray nozzle to deliver powder for application to a fastener. The distribution block is configured for a particular number of fill tubes and may be interchanged with other distribution blocks, such as blocks 17 and 19, having different numbers of fill tubes as illustrated in FIGS. 3 and 4. Thus, the apparatus of the present invention may be adapted for use with one, two, three, four or even more spray nozzles. The distribution block 16 also includes one or more breathe ports 48 which communicate with the common passageway 42. Many conventional spray nozzles in use today use a high pressure air supply to entrain the powder. These nozzles are known to create a negative pressure in the powder supply. In other words, the nozzle tends to aspirate powder from the powder feed system. Port 48 insures that any aspiration effect caused by the spray nozzle will not act to increase the powder flow rate exiting the discharge ports. Alternatively, the distribution block 16 may be constructed without breathe ports 48 or other openings, to thereby utilize negative pressure to assist the powder flow. Still further, the distribution block may be provided with an adjustable aspiration port, to thereby afford further control of powder flow rate.

The housing 12 is mounted to any conventional linear vibration device 49 well known to those of skill in the art. Typically, such vibrators includes frequency and/or amplitude controls allowing adjustment of the vibratory action.

Since the accurate metering of the powdered resin to independent nozzles may be important in some applications, it is desirable to level housing floor 20 and the inner openings of the discharge ports 26 so that powder flow into each port 26 is approximately equal. To that end, a visual level indicator 50 is mounted to end wall 24 to facilitate leveling adjustments.

For an alternative embodiment, a horizontal platform 52 may be mounted to barrier 34. This platform directs powder flow first toward wall 22, then down to floor 20 and then along floor 20 under barrier 34 into discharge ports 26. This arrangement has been found desirable for low volume flow rates.

In accordance with the present invention, a wide range of powdered resin materials and flow rates can be accommodated. By adjustment of the vibration level, the powder height in the reservoir and the barrier metering aperture, the flow rate may be effectively controlled. Flow rates from about 0.10 grams per minute to as high as about 50.0 grams per minute may be achieved.

Of course, it should be understood that various changes and modifications to the preferred embodiments described herein will be apparent to those skilled in the art. Such changes and modifications can be made without diminishing its attendant advantages. It is therefore intended that such changes and modifications be covered by the following claims:

We claim:

1. An apparatus for feeding and metering powdered resin to a powder spray nozzle to thereby apply the resin to a fastener, comprising:

a housing defining a powder reservoir, said housing being mounted to a linear vibration device and having a generally horizontally oriented floor;

a powder storage hopper having an outlet disposed to deliver the powdered resin to the reservoir;

a powder distribution block mounted to the housing and having at least one generally vertical fill tube with an upper powder receiving end and a lower powder distributing end;

a plurality of generally horizontally oriented discharge ports extending through a wall of the housing, each port having an inner end in communication with the reservoir and an outer end located to deposit the powdered resin into the receiving end of a powder fill tube; and the powder fill tube distributing end being in communication with the powder supply to the spray nozzle;

a barrier mounted to said housing to control powder flow from the reservoir to the discharge ports; and said barrier having at least one powder flow aperture and a tube extending from said aperture toward said discharge ports.

2. The apparatus of claim 1 wherein the barrier is adjustably mountable to the housing.

3. The apparatus of claim 1 wherein the distribution block is adjustably mountable to the housing.

4. The apparatus of claim 1 wherein the distribution block has at least one breathe port associated with each powder fill tube.

5. The apparatus of claim 1 wherein each discharge port is positioned adjacent the floor of the reservoir.

6. The apparatus of claim 1 further comprising a plurality of distribution blocks, each being interchangeably mountable to the housing and having a number of fill tubes different from that of other distribution blocks.

7. The apparatus of claim 1 further comprising a visual indicator of the horizontal level of the discharge ports relative to one another.

* * * * *